United States Patent [19]

Potente et al.

[11] Patent Number: 4,638,521

[45] Date of Patent: Jan. 27, 1987

[54] ORAL CLEANING DEVICE

[76] Inventors: John E. Potente; Daniel F. Potente, both of 4 Nichols Ct., Muttontown, N.Y. 11545

[21] Appl. No.: 765,459

[22] Filed: Aug. 14, 1985

[51] Int. Cl.[4] ..... A46B 9/04

[52] U.S. Cl. ..... 15/111; 128/62 A; 15/167 R

[58] Field of Search ..... 128/304, 62 A; 15/111; 433/141

[56] References Cited

U.S. PATENT DOCUMENTS 1,891,864 12/1932 Barrett ..... 15/111

4,356,585 11/1982 Protell et al. ..... 15/111

*Primary Examiner*—Robert Peshock

*Attorney, Agent, or Firm*—Bauer & Amer

[57] ABSTRACT

An oral cleaning device having a handle and a bowl-shaped head within which are cleaning elements which when applied to the mouth surfaces, the head flexes allowing the cleaning elements to contact the surface tissues.

16 Claims, 6 Drawing Figures

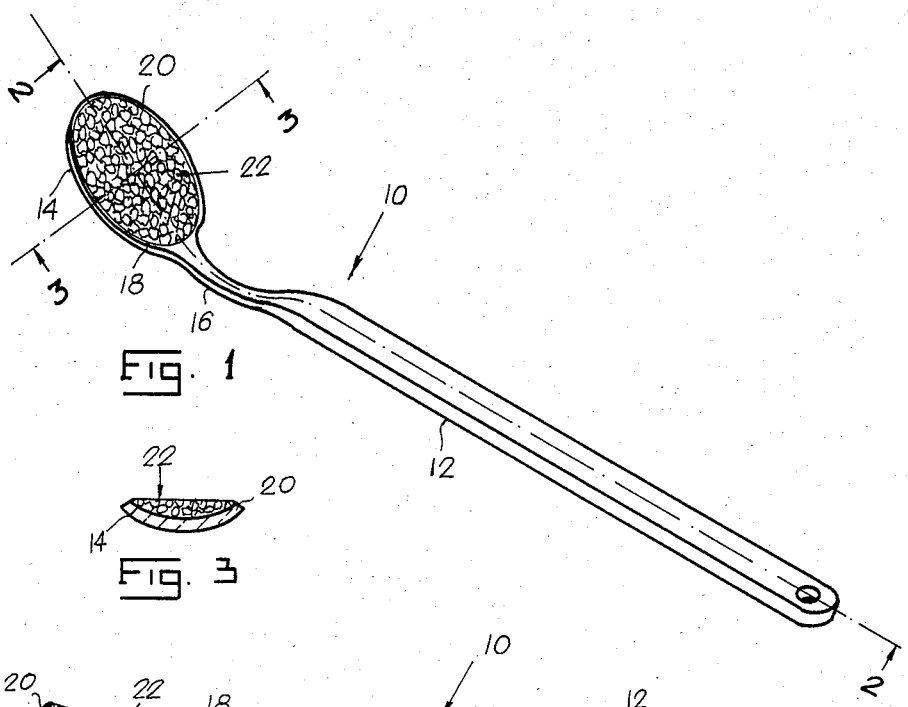
Fig. 1
Fig. 3
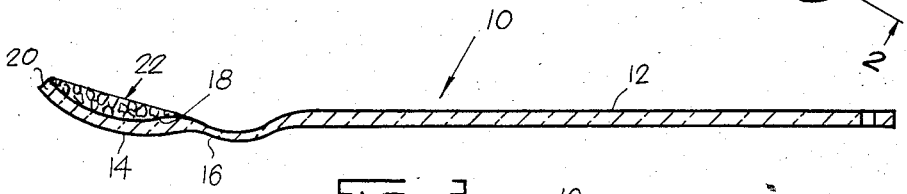
Fig. 2
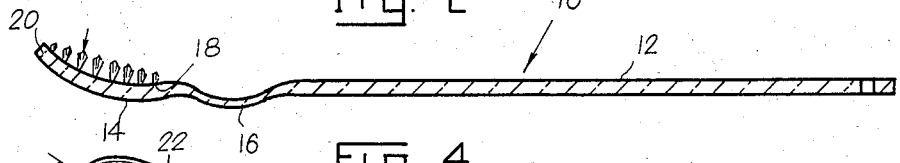
Fig. 4
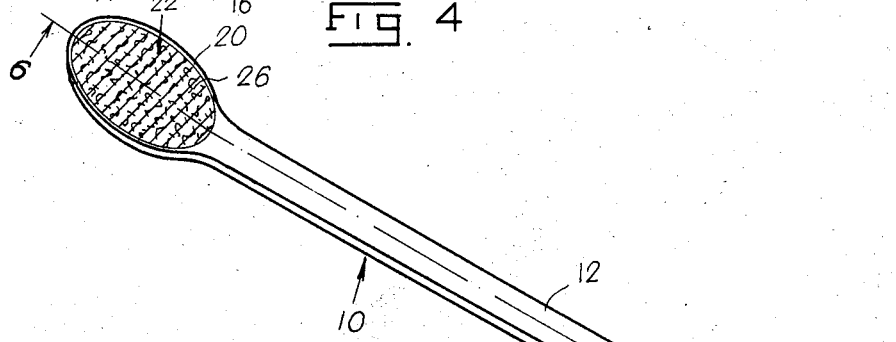
Fig. 5
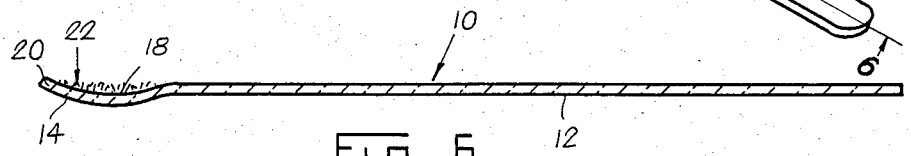
Fig. 6

ORAL CLEANING DEVICE

BACKGROUND OF THE INVENTION

The present invention relates to an oral cleaning device and, in particular, to a scraper for removing bacteria from the tongue.

From the time of childhood, people are taught to brush their teeth to remove bacteria from the teeth to inhibit or prevent tooth decay. However, while the brushing does remove bacteria from the tooth surfaces, a substantial amount of bacteria remains like a reservoir on the dorsal surface of the tongue so as to permit the rapid regrowth and return of the bacteria to the teeth to prevent continued decay.

It has been recognized that more is required than the mere removal of bacteria from tooth surfaces. People who suffer from mouth odor conditions such as halitosis, particularly fail to remove sufficient amounts of bacteria from the remote surfaces of the mouth such as the posterior dorsal surfaces of the tongue. The cleansing of the teeth alone, therefore, is not sufficient to eliminate or severely reduce the growth of tooth bacteria and decay and it has been found necessary to reduce the extent of the bacteria remaining in the adjacent portions of the oral cavity.

Several suggestions for devices adapted to remove bacteria from the tongue and mouth have been made in the prior patented disclosures of Barrett U.S. Pat. No. 1,891,864, Runnels U.S. Pat. No. 2,583,750 and McNeill U.S. Pat. No. 2,491,274.

Each of the known devices suggested and exemplified by the foregoing patents suffers from various problems. For example, the McNeill patent is a substantially massive tongue cleaning sponge which fails to conform to the contour fo the distal portion of the tongue where the major portion of bacteria remains after the cleaning and rinsing of the mouth and the teeth. The thickness of the sponge and its failure to conform to the shape of the tongue thus inhibit its use within the distal areas of the mouth. The thickness of the sponge especially contributes to gagging by the user and, therefore, mitigates against such use.

The Runnels patent teaches a tongue scraper which, although provided with scraping surfaces, is relatively thick in dimension and again fails to conform to the shape of the distal portion of the tongue to be cleaned. It, too, suffers from the same problems as McNeill. Further, the scraping surfaces are formed of ridges and ribs which extend above the surface of the body, thereby materially increasing its thickness and preventing its use in the back or distal areas of the mouth.

The Barrett disclosure teaches a scraper that, because of its thickness, increased by the brushes, rigid tines, and thick sponge, is not capable of being used in or applied to the back or distal areas of the mouth without inducing severe gagging. Thus, the net effect of the Barrett construction is that it is limited in use to the frontal or proximal areas of the tongue and is ineffectual for use in the distal more restricted areas.

It is an object of the present invention to provide an oral cleaning device, in particular, a tongue scraper in which the disadvantages enumerated above are overcome.

It is a further object of the present invention to provide an oral cleaning device which is capable of scraping clean the remote or distal surfaces of the tongue to the vallate papillae without adverse effects.

It is a further object of the present invention to provide an oral cleaning device which has a head portion that is flexible and capable of easily conforming to the contours of the surfaces of the tongue.

The foregoing, as well as other objects and other advantages will be apparent from the following disclosure of the present invention.

SUMMARY OF THE INVENTION

According to the present invention, an oral cleaning device is provided having a handle, and a cleaning head connected at one end of the handle with the head in the form of a semi-ovoid, i.e., a bowl substantially in the shape of a generally shallow spoon within which is arranged one or more cleaning elements which may extend in height substantially equal to the rim of the head.

Preferably, the head is formed so as to be flexible and resilient whereby it can conform readily to the curvature of the tongue. To enhance flexibility and contour shaping, the rim of the head is flattened to provide a band-like perimeter that lies entirely in a single common plane. Thus, the rim does not cause any abrasion and flexes easily into conformance with the various curvatures of the mouth with which it comes into contact while simultaneously preventing the cleaning elements from damaging the surface tissue. In addition, it is preferable for some applications of the present invention to provide a thin, highly flexible handle extension of the head.

Full details of the present invention are set forth in the following description and illustrated in the accompanying drawings.

BRIEF DESCRIPTION OF THE DRAWINGS

In the Drawings:

FIG. 1 is a perspective view of the oral cleaning device embodying principles of the present invention;

FIG. 2 is a cross-section of FIG. 1 along lines 2—2 showing the cleaning head with one form of cleaning element;

FIG. 3 is a cross-section of FIG. 1 along lines 3—3;

FIG. 4 is a view similar to that of FIG. 2 showing the cleaning head with bristles;

FIG. 5 is a perspective view of a cleaning device according to the invention in which the handle and head are relatively flat with monolithically formed cleaning elements; and FIG. 6 is a cross-section of FIG. 5 taken along lines 6—6 thereof.

DESCRIPTION OF THE INVENTION

The oral cleaning device of the present invention generally depicted by the numeral 10 comprises a handle 12 having a head 14 joined thereto via a neck 16. The device 10 may be analogized to a relatively flat spoon having its head 14 in the shape of a semi-ovoid defining a concave depression or hollow bowl 18 and an eliptical rim 20, flattened to provide a narrow, flat, shallow, and smooth band which along its entire perimeter may lie within a common plane.

Located within the bowl 18 is a flexible, yieldable cleaning element, generally depicted by the numeral 22. The concave shape 18 of the head 14 is curved in the direction of the length of the device 10 and also in a direction substantially perpendicular thereto. The double curvature is relatively flat and thin, preferably between eight thousandths and one hundred twenty-five thousandths of an inch, so as to keep to a minimum the thickness of the device 10 at its head 14. As will become clearer as the description proceeds, the relatively shallow depth of the head 14 is sufficient to contain a cleaning element 22 within its defines.

The curvature of the concavity 18 of the head 14 is shaped to initially conform to the curvature of the tongue. To this end, the head 14 and its concavity are relatively flat so as to be as shallow in height as possible. This enables the head to be inserted back into and to be wiped along the distal surfacaes of the tongue to the circumvallate papillae. The relative thinness of the head, including its cleaning element 22, permits this to be accomplished without gagging the user or presenting an unpleasant reaction.

The cleaning element 22 may take many forms. In FIGS. 1, 2 and 3, it is shown as a very shallow, easily deformed sponge-like element that is bonded integrally to the concavity within the height defines of the rim 20. In use, its exposed surface is brought into rubbing or scraping contact with the curved surfaces of the tongue to clean the same by removing bacteria therefrom. Because the cleaning element 22 is substantially equal in height to the rim 20 of the head 14, the shallow height of the head is enabled to be moved in a cleaning motion over the exposed surfaces of the tongue as far back as to the circumvallate papillae without producing gagging.

The head 14 may be made of a relatively thin plastic or other material that flexes and yields upon rubbing cleaning contact with the tissues of the mouth. Upon such cleaning contact the rim 20 may flex into an even flatter arc, thereby producing a head that is even flatter and thinner than its original concave thickness and shape. This enables its use within the limited and confined areas of the mouth and is especially useful in treating the elderly, young children, and those who are afflicted with mouth disorders and diseases that are otherwise sensitive and painful to the touch.

In FIG. 7 the cleaning element 22 is shown to comprise a plurality of bristles 24 imbedded and held within the surface of the head 14. The bristles 24 are preferably arranged in close proximity to each other. The bristles 24 may be in random arrangement or with a uniformity of arrangement or design, if desired. As in the embodiment of FIG. 2, it will be observed here that the bristles 24 are relatively short so as to enable the head 14 to be maintained at a minimum thickness. They are shown to be within the height of the rim 20 for readilay cleaning curved surfaces, but are exposed more fully when the rim flexes and flattens during cleaning contact with the surfaces of the mouth.

As seen in the embodiments of FIGS. 1, 2, 3, and 4, the handle 12 is formed of a relatively rigid, thick body having a neck 16 of reduced size and rigidity. The reduced neck 16 provides resiliency and a bendable hinge-like connection between the more rigid handle 12 and the flexible head 14. This affords a large handle that is easily manipulated, yet enables the head 14 to bend relative to the handle to avoid rough treatment or abraiding the tissues of the tongue and mouth in the event the user applies too great a force or pressure on the handle 12.

The embodiment of the invention shown in FIGS. 5 and 6 is substantially the same as that disclosed in the prior embodiments and, therefore, like numerals are used to identify like parts.

It has been pointed out that the prior art fails to recognize the importance of cleaning the remote or distal surfaces of the mouth and tongue by failing to provide teachings of devices of sufficient thinness to enable their usage in such remote or distal areas. The aforedescribed embodiments of FIGS. 1 to 4 treat such problem by providing teachings of structures capable of accomplishing the desired results. Thus, the embodiments of FIGS. 1 to 4 contemplate the use of the present inventive oral cleaning device in the home acquiring such common usage as the toothbrush. However, there is a recognized need for the present oral cleaning device in such institutes as hospitals, old-age nursing homes, nurseries, mental institutions, and the like on a one or single use, throw-away basis.

To this end, the present oral cleaning device 10 or FIGS. 5 and 6 comprises the handle 12 and head 14 made integral and monolithic of a relatively thin sheet of between eight thousandths of an inch (0.008") and one hundred twenty-five thousandths of an inch (0.125") of flexible material, as plastic or the like. The device 10 may be made almost paper thin in which the head 14 is provided with an almost imperceptible concavity 18 that is roughened or embossed with a monolithic array of upstanding cleaning elements 22.

As seen in FIG. 5, the cleaning elements 22 may take the form of shallow grooves and/or ridges 26 integrally and monolithically formed with the head. They are arranged generally within the bowl concavity 18 that has a smooth-annular side wall or rim 20. The design or arrangement of these grooves and ridges 26 is not critical. They may be arranged parallel to each other, in line with or transverse to the long axis of the head, in criss-cross or angularly disposed fashion, sor randomly throughout the surface. The groves and ridges also need not be of the same depth or of the same height. It will be observed, however, that while being substantially equal in height to the rim 20, they come into full cleaning contact with the surfaces and tissues of the tongue and mouth.

The cleaning elements 22 of FIGS. 5 and 6 will function in essentially the same manner as the previously described cleaning elements of FIGS. 1 to 4. If desired, the cleaning elements 22 may be of Velcro material welded or bonded to the surface of the head 14. The handle 12 is shown narrowed in width for convenience of illustration. However, if it is desired to provide for less flexibility between the handle and the head 14 in the present embodiment of FIGS. 5 and 6, then the handle may be widened or even thickened.

In use, as in the aforedesribed embodiments, the perimetric area of the head 14 of the embodiment of FIGS. 5 and 6 will flex and distort from its original shape to conform more exactly to the shape and contour of the surfaces of the tongue and the mouth into which it is placed or pressed into cleaning contact. This will expose more of the cleaning elements 22 and cause them to come into more intimate cleaning contact with such surfaces. Naturally, as a greater force is applied to the device 10 by the use, more of the cleaning element will be caused to come into contact with the cleaned surfaces. During such pressed cleaning contact the pliable tissue of the tongue and mouth will also deform into cleaning contact with the cleaning element thereby enabling the device 10 to be of relatively shallow height and thinness.

The disclosed embodiments lend themselves to being molded as integral constructions of a handle, head, connecting neck, and cleaning elements. Similar materials and processes as that used for the manufacture of conventional toothbrushes can be employed in making the present invention. It has been found, however, that the single monolithic relatively flat construction of the embodiment of FIGS. 5 and 6 may be made inexpensively to enable them to be used once and then thrown away.

In each of the embodiments described, it will be seen that the head is formed relatively thin and flexible. Thus, only a very slight pressure is needed to deform or distend the smooth-side wall of the head 14 allowing the cleaning elements 22 on the head to contact the tissue surfaces being cleaned. As the flat rim 20 of the head 14 contacts the tissue surfaces, it produces sufficient feedback to the user so that the user is made fully aware of the surface cleaning contact and senses the amount of pressure required for cleaning. As a result, the user is able to carefully control the extent of pressure to be applied to avoid undersirable scratching, uncomfortable abrading and accidental cutting of the surfaces of the tongue or mouth, inherent in the prior art.

Since several embodiments and modifications have been illustrated here, and others will be known to those skilled in this art, the present disclosure is intended to be illustrative only and not limiting of the scope of the invention.

What is claimed is:

1. An oral cleaning device comprising a generally spoon-shaped body having a handle coxtensive with a bowl-like head that forms the insertion end of said device at one end, at least one cleaning element located in said bowl and extending from the surface thereof and extending upward from and about the curved interior of the bowl substantially to the rim of said bowl, and said cleaning element being curved to fit the curved contour of the tongue and mouth and conforming with the surfaces of the tongue and mouth with which it comes into contact to permit said cleaning elements to clean the same.

2. The device according to claim 1 wherein said cleaning elements are bristles.

3. The device according to claim 1 wherein said cleaning elements are integrally formed ridges, grooves and/or embossments.

4. The device according to claim 3 wherein said bowl and cleaning elements are unitarily molded.

5. The device according to claim 1 wherein said handle is flexibly attached to said bowl.

6. The device according to claim 5 wherein said handle and bowl are flexible.

7. The device according to claim 1 wherein the peripheral rim of said head is flattened to form a continuous band, said band lying entirely in a common plane.

8. The device according to claim 7 wherein said bowl flexes and yields to reduce in thickness when pressed into cleaning contact with the tongue and mouth.

9. An oral cleaning device comprising an insertion cleaning head having a shallow open depression defined therein shaped to the contour of the tongue and mouth, cleaning means in said depression extending outward from the depth thereof substantially equal to the height of the opening thereof and being movable for cleaning contact with the surfaces of the tongue and mouth, and a handle connected with said head to manipulate the same and said cleaning means into cleaning contact with the surfaces of the tongue and mouth.

10. The device according to claim 9, said cleaning head being relatively thin and preferably between eight thousandths and one hundred twenty-five thousandths of an inch.

11. The device according to claim 9, said cleaning head being deformable when applied under pressure to the surfaces of the tongue and mouth.

12. The device according to claim 11, said cleaning head being of a flexible material of a thickness less than one hundred twenty-five thousandths of an inch.

13. The device according to claim 9, said cleaning head, handle, and cleaning means being monolithic.

14. The device according to claim 13, said connection of said handle with said head being flexible to enable relative flexing movement therebetween.

15. The device according to claim 14, said cleaning head depression being deformable, and said cleaning means within said depression being increasingly exposed therefrom for contact with the surfaces to be cleaned by the increased deformation of the depression of said cleaning head against the surfaces to be cleaned.

16. The device according to claim 13, the thickness of said head preferably being between eight thousandths and one hundred twenty-five thousandths of an inch.

* * * * *